US010167119B2

(12) United States Patent
Wiesman

(10) Patent No.: US 10,167,119 B2
(45) Date of Patent: Jan. 1, 2019

(54) SPOUT FOR LID

(71) Applicant: PRECISION VENTURES, LLC, Waltham, MA (US)

(72) Inventor: Joshua Wiesman, Weston, MA (US)

(73) Assignee: Helen of Troy Limited, St. Michael (BB)

( * ) Notice: Subject to any disclaimer, the term of this patent is extended or adjusted under 35 U.S.C. 154(b) by 195 days.

(21) Appl. No.: 14/766,472

(22) PCT Filed: Dec. 18, 2013

(86) PCT No.: PCT/US2013/076109

§ 371 (c)(1),
(2) Date: Aug. 7, 2015

(87) PCT Pub. No.: WO2014/100168

PCT Pub. Date: Jun. 26, 2014

(65) Prior Publication Data

US 2015/0368006 A1 Dec. 24, 2015

Related U.S. Application Data

(60) Provisional application No. 61/738,425, filed on Dec. 18, 2012.

(51) Int. Cl.
*B65D 47/20* (2006.01)
*A47G 19/22* (2006.01)
(Continued)

(52) U.S. Cl.
CPC ..... *B65D 47/2031* (2013.01); *A47G 19/2272* (2013.01); *B65D 47/06* (2013.01); *A61J 11/0065* (2013.01); *B65D 2547/066* (2013.01)

(58) Field of Classification Search
CPC . B65D 47/2031; B65D 47/06; A47G 19/2272
(Continued)

(56) References Cited

U.S. PATENT DOCUMENTS 4,690,375 A 9/1987 Vorhis
6,874,760 B2 4/2005 Steckel
(Continued)

FOREIGN PATENT DOCUMENTS

CN 1669502 9/2005
CN 201640873 11/2010
(Continued)

OTHER PUBLICATIONS

European Search Report dated Sep. 27, 2016.
International Search Report filed in PCT/US2013/076109 dated Apr. 24, 2014.

*Primary Examiner* — Jeffrey Allen
(74) *Attorney, Agent, or Firm* — Rankin, Hill & Clark LLP

(57) ABSTRACT

A spout (20) for a lid (10), where the lid (10) is constructed and arranged to fit over and close an open top of a container (150). The spout (20) has an elongated fluid conduit (22) having two ends (24, 25) and lying along a conduit longitudinal axis (23). The conduit (22) has a pair of opposed convex curved sidewalls (61, 63) that meet at two opposed locations (64, 65) at an angle of less than 180 degrees to define a generally elliptical cross-sectional shape that has a major axis (51) that passes through the sidewall meeting locations (64, 65).

18 Claims, 18 Drawing Sheets

(51) Int. Cl.
*B65D 47/06* (2006.01)
*A61J 11/00* (2006.01)

(58) Field of Classification Search
USPC ..... 222/490; 220/714; 251/342
See application file for complete search history.

(56) References Cited

U.S. PATENT DOCUMENTS

| | | | | |
|---|---|---|---|---|
| 7,533,783 | B2 | 5/2009 | Choi et al. | |
| 2003/0222238 | A1 * | 12/2003 | Getzewich | B65D 47/2018 251/342 |
| 2006/0201902 | A1 | 9/2006 | Brown et al. | |

FOREIGN PATENT DOCUMENTS

| | | | | |
|---|---|---|---|---|
| DE | 20 2006 012 915 | | 11/2006 | |
| WO | WO 2011033477 | A1 * | 3/2011 | A47G 19/2272 |

* cited by examiner

SPOUT FOR LID

FIELD

This disclosure relates to a spout for a lid, where the lid can be adapted to fit over and close an open top of a container.

BACKGROUND

Children sometimes ingest from cups foods such as liquids (e.g., water, milk, formula, juice) and more viscous foods such as purees, yogurt, smoothies and the like. Reusable open-top cups need to have removable lids so they can be cleaned and refilled. The lid needs to carry a delivery spout. Some spouts have bite valves that are compressed with the lips, teeth or gums so as to open the valve and deliver the food. The valve should open easily yet close quickly to inhibit spills. It should also open wide enough to deliver the food without the need for the child to suck on the spout very hard.

SUMMARY

This disclosure features a spout for a lid. The lid may be adapted to fit over and close an open top of a container. The spout can include an elongated fluid conduit lying along a conduit longitudinal axis and having a pair of opposed convex curved sidewalls that meet at two opposed locations at an angle of less than 180 degrees to define a generally elliptical cross-sectional shape that has a major axis that passes through the sidewall meeting locations. A bite valve comprising a membrane is located within the conduit. The bite valve may be but need not be spaced from the ends of the conduit. The membrane is coupled to both walls and spans the conduit so as to fully block the conduit when the valve is not activated or opened by the user's action. The membrane can be but need not be generally dish-shaped or dome-shaped. A slit through the membrane lies along a slit axis that is preferably but not necessarily transverse to (e.g., normal to) the major axis of the conduit. Preferably, the conduit sidewalls are essentially identical and the spout is a unitary part molded from an elastomeric material, preferably silicone.

The membrane can have a top surface and a bottom surface, and the bite valve may further comprise a reinforcing ridge projecting outwardly from the bottom of the membrane. The slit may be generally linear when viewed from above. The reinforcing ridge may be co-linear with the slit. The slit may pass through the reinforcing ridge. The ridge may be generally semi-circular in cross section. The ridge may be bisected by the slit.

The spout may further comprise a pair of shallow indentations, one on the outside of each conduit sidewall and located at the approximate location of the slit. The spout may further comprise two wall-strengthening ribs, one projecting inwardly from each of the sidewalls and both coupled to the top of the membrane. The ribs may be centered on the slit. Each rib may define an indentation at the slit location. Each indentation may extend along at least most of the rib in the direction of the conduit longitudinal axis.

The spout sidewalls may be essentially identical. The conduit and the bite valve may comprise a unitary part molded from an elastomeric material. The conduit may have a minor axis that is orthogonal to the major axis, and the slit may be co-linear with the minor axis. The slit may extend along most of the length of the minor axis. The bite valve may be symmetric about both the major axis and the minor axis. The membrane may be generally dome shaped. The membrane may be generally uniform in thickness, and along the minor axis the membrane may define an arc-shape. Along the major axis the membrane may be generally V-shaped. The lid may be convex, flat, or concave.

Also featured herein is a spout for a lid, where the lid is constructed and arranged to fit over and close an open top of a container. The spout may include an elongated fluid conduit having two ends and lying along a conduit longitudinal axis, the conduit having a pair of opposed convex curved sidewalls that meet at two opposed locations at an angle of less than 180 degrees to define a generally elliptical cross-sectional shape that has a major axis that passes through the sidewall meeting locations. The spout may further include a bite valve comprising a generally dome-shaped membrane located within the conduit and spaced from the ends of the conduit, the membrane coupled to both sidewalls so as to fully block the conduit, and a slit through the membrane, where the slit lies along a slit axis that is transverse to the major axis of the conduit, wherein the membrane has a top surface and a bottom surface, and wherein the bite valve further comprises a reinforcing ridge projecting outwardly from the bottom of the membrane, wherein the slit is generally linear when viewed from above, and the reinforcing ridge is co-linear with the slit, and wherein the slit passes through the reinforcing ridge. There may be two wall-strengthening ribs, one projecting inwardly from each of the sidewalls, the ribs coupled to the top of the membrane, wherein the ribs are centered on the slit. The conduit may have a minor axis that is orthogonal to the major axis and wherein the slit is co-linear with the minor axis, wherein the slit extends along most of the length of the minor axis and wherein the bite valve is symmetric about both the major axis and the minor axis.

The membrane may be generally uniform in thickness. Along the minor axis the membrane may define an arc-shape and along the major axis the membrane may be generally V-shaped.

Examples of the spout for a lid that is adapted to fit over and close an open top of a container are shown in the drawings. The spout is typically an integral part of a one-piece molded lid that is constructed and arranged to fit over and seal with the top lip of an open-top cup or other container. The lid can be injection molded from an elastomeric material such as a silicone compound. The lid can alternatively be made from more than one part with the parts coupled together through mechanical joints, ultrasonic welding, chemical bonding, or another adhesion method.

Examples of containers that can be closed by such a lid are numerous and include sippy cups for use by young children (typically for fluids or purees), water bottles, and storage containers that need to be sealed so the contents do not spill, but from which the user desires to drink or otherwise ingest the contents.

BRIEF DESCRIPTION OF THE DRAWINGS

The disclosure is supported by the below-described non-limiting examples shown in the drawings, in which.

DETAILED DESCRIPTION

Figure 8:
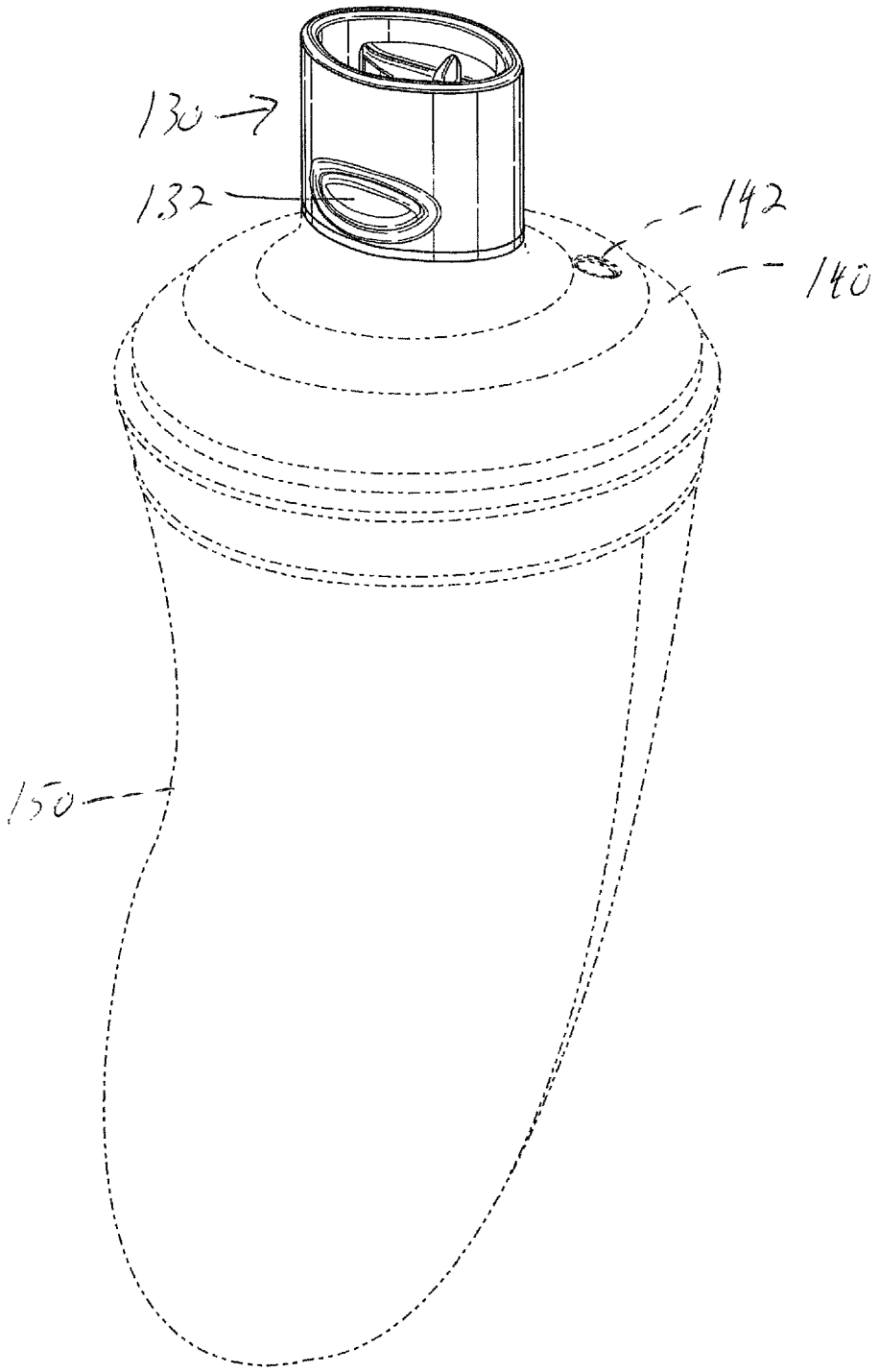
FIG. 8 shows a spout on a lid, which is on a cup.

A first example of a spout for a lid is shown in FIGS. 1-5. Lid or cap 10 includes a lid body 12 which has lower rim 13 that is adapted to fit over and create a liquid-tight seal with the rim of a container (a non-limiting example of a container 150 is shown in FIG. 8) in a manner that is well known in the field and does not need to be further described. One-way valve or vent 14 allows air to enter into the container as fluid is withdrawn, to prevent the formation of a vacuum, as is also well known. Vent 14 is not essential to the function of the spout. Vent 14 allows the user to continuously drink from the spout—an intentionally designed feature. Without vent 14 the spout can be used until vacuum build up prevents the release of further liquid. At this point the user would need to crack the bite valve to allow the pressure in the cup to become equal with the ambient pressure.

Spout 20 is essentially an elongated fluid conduit 22 with an internal bite valve 21 that is adapted to be opened by the user via pressure applied to the outside of the spout through the lips, teeth and/or gums. Conduit 22 lies along longitudinal axis 23, FIG. 1 (axis 23 projects normal to the page in FIG. 1). In this non-limiting example spout 20 is located vertically (i.e., axis 23 is vertical when lid 10 is located on a cup that is standing upright). Also, in this non-limiting example spout 20 is located at the center of lid body 12. Conduit 22 is defined by opposed convex curved sidewalls 61 and 63 which meet at locations 64 and 65; sidewalls 61 and 63 are preferably but need not be essentially identical. When the spout is an integral molded member, sidewalls 61 and 63 and locations 64 and 65 are all portions of a continuous outer wall that is generally elliptically shaped and defines major axis 51 and minor axis 53.

Figure 2A:
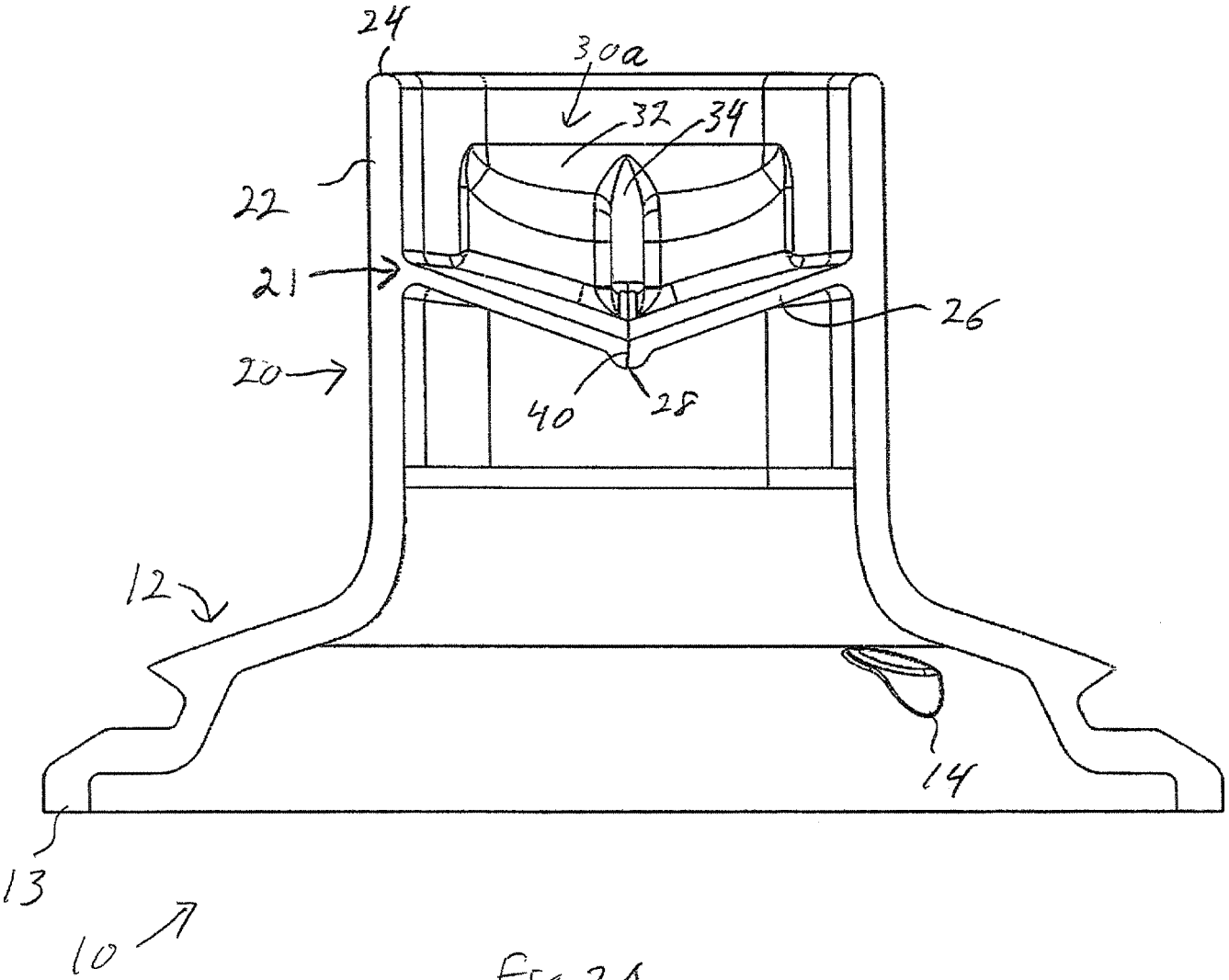
FIG. 2A is a cross-section taken along the major axis of the spout of FIG. 1.
Figure 2B:
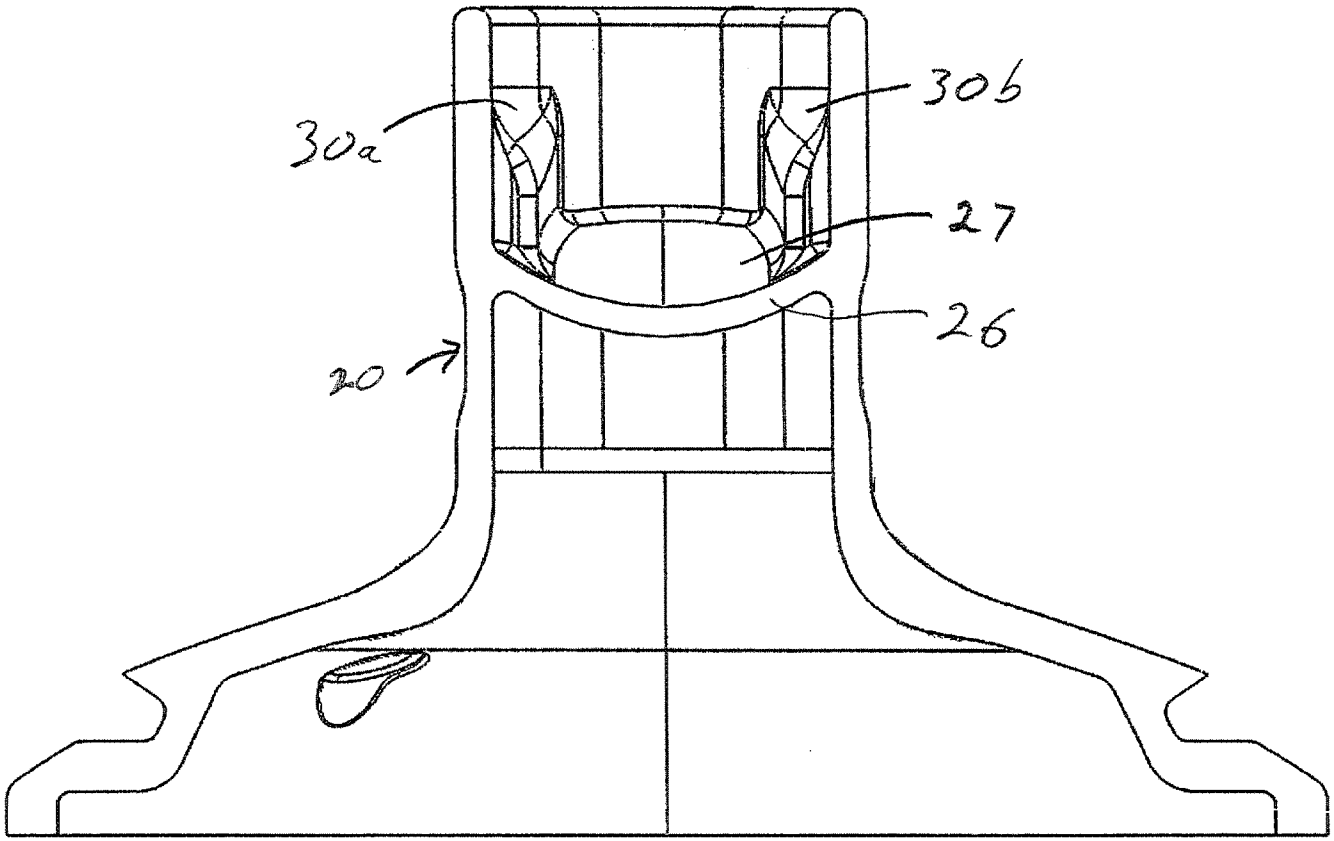
FIG. 2B is a cross-section taken along the minor axis of the spout.

Bite valve 21 comprises membrane 26 that is generally dish-shaped or generally dome-shaped; it lies along a curved plane that is convex toward the bottom of the conduit (i.e., toward the contents of the cup on which the lid is located). Membrane 26 presents a generally partially spherical bottom surface 29 that faces the fluid contents of the cup, and an opposed top surface 27 that faces the outside conduit end 24 which will be located in the user's mouth. As can be seen in FIGS. 2A and 2B, membrane 26 is generally a partially spherical surface along the slit axis (or the projection of the minor axis), and is more generally "V"-shaped along major axis 51. These shapes generally describe this example of the membrane but the shape is not exactly geometric. Membrane 26 intersects sidewalls 61 and 63 at an acute angle 19 defined by lower or bottom surface 29 and conduit 22. Angle 19 may be but need not be approximately 60 degrees. By making the angle 19 smaller (less than 60 degrees), the valve will react faster, i.e., open and close in a more sensitive manner. The combination of angle 19 and the radius of curvature of membrane 26 helps to determine the speed and sensitivity at which the valve will open and shut as well as how widely the valve will physically open.

The center of membrane 26 lying along minor axis 53 has a lower reinforcing ridge 28, which preferably is generally semi-circular in cross-section. A single slit 40 is made through membrane 26 and ridge 28 along the middle of ridge 28 to provide for valve 21 to be opened under use control, to allow the contents of the container to be dispensed through valve 21 into the user's mouth. Slit 40 preferably but not necessarily bisects both membrane 26 and ridge 28. For a curved membrane, ridge 28 as well as slit 40 are curved in one dimension and straight when viewed from above, and thus lie in a vertical plane that includes the minor axis.

Spout 20 has on its outside shallow indentations 54 and 55 that serve as tactile locating elements for the user's lips. They are located approximately level with the location of membrane 26, preferably proximate the minor axis along which the slit lies. The center of each indentation 54, 55 may be positioned toward the ends of ridge 28. With this arrangement, when the user applies inward force by slightly closing the lips or mouth with the lips at the locations of indentations 54 and 55, sidewalls 61 and 63 are pushed closer together. This causes valve 21 to open. The depth of indentations 54 and 55 can be approximately 0.2 mm, which is enough depth for the lips to register with the indentations.

Figure 1:
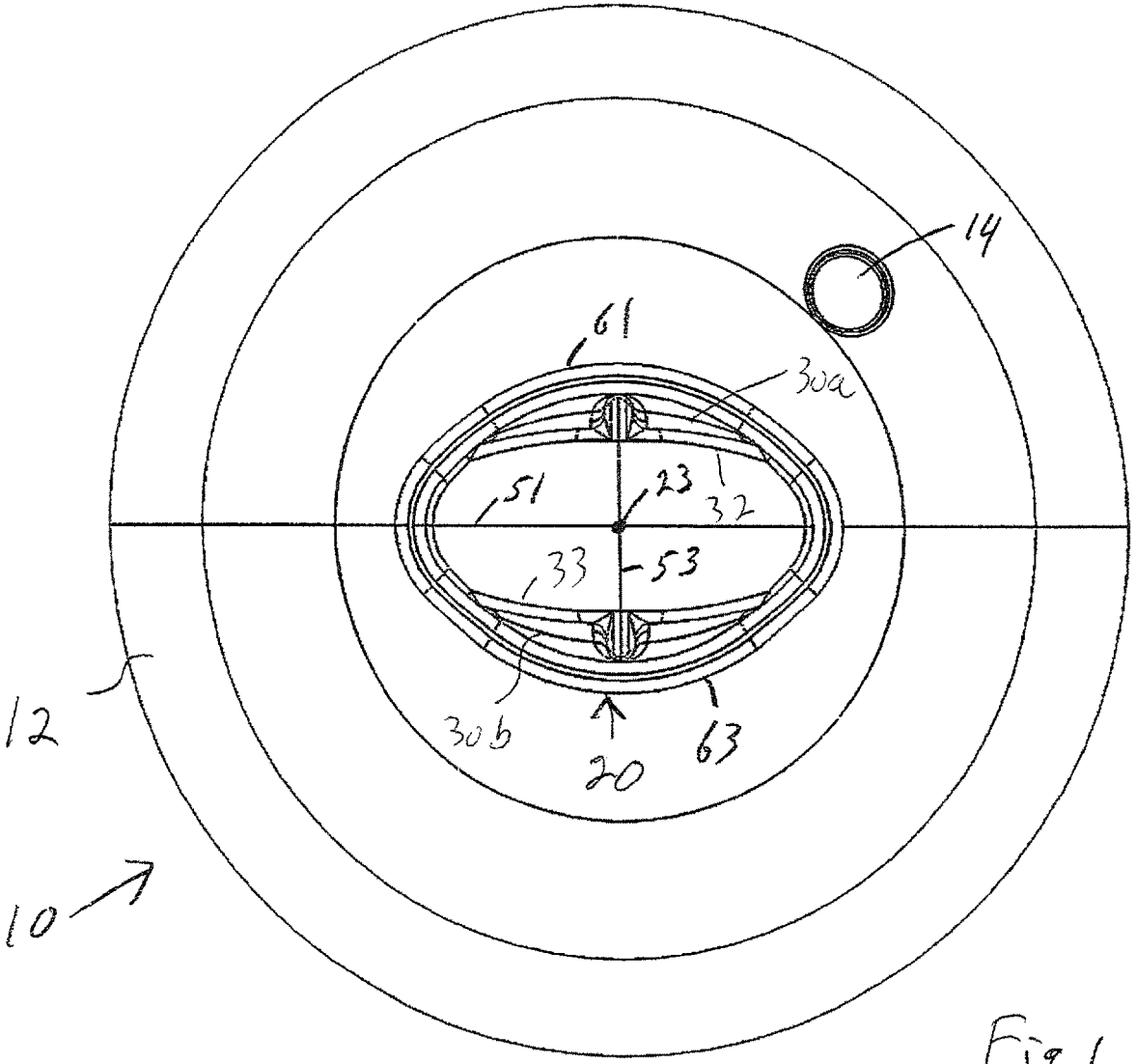
FIG. 1 is a top view of a spout that projects from the top of a lid.
Figure 3A:
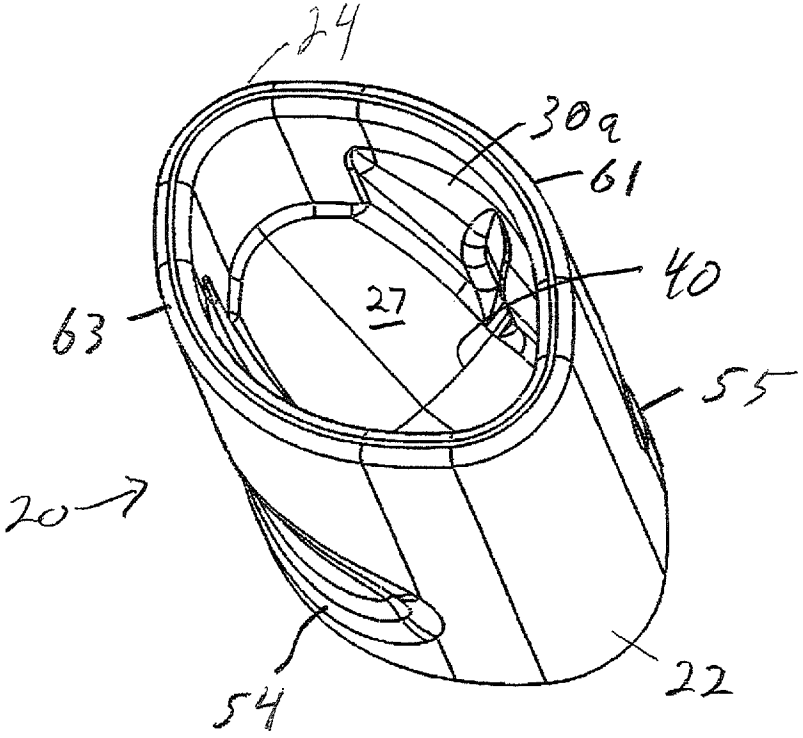
FIG. 3A is a top perspective view of the spout.
Figure 3B:
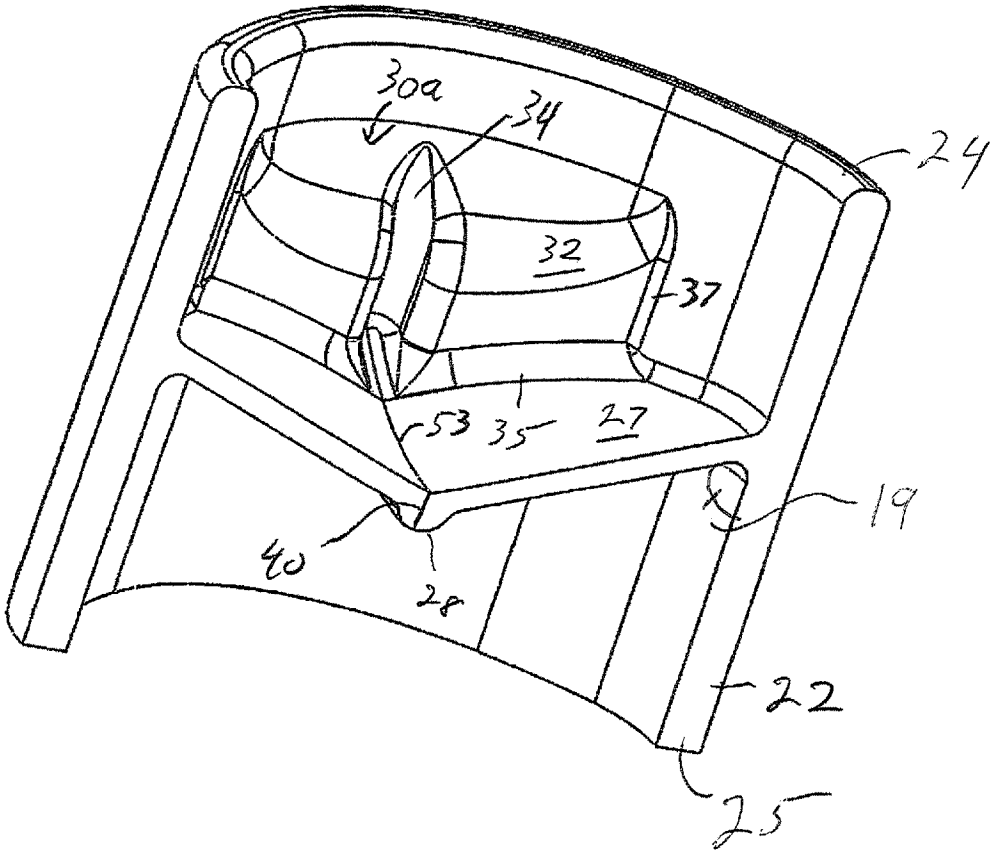
FIG. 3B is a perspective cross-section taken along the major axis of the spout, orthogonally to the slit.
Figure 3C:
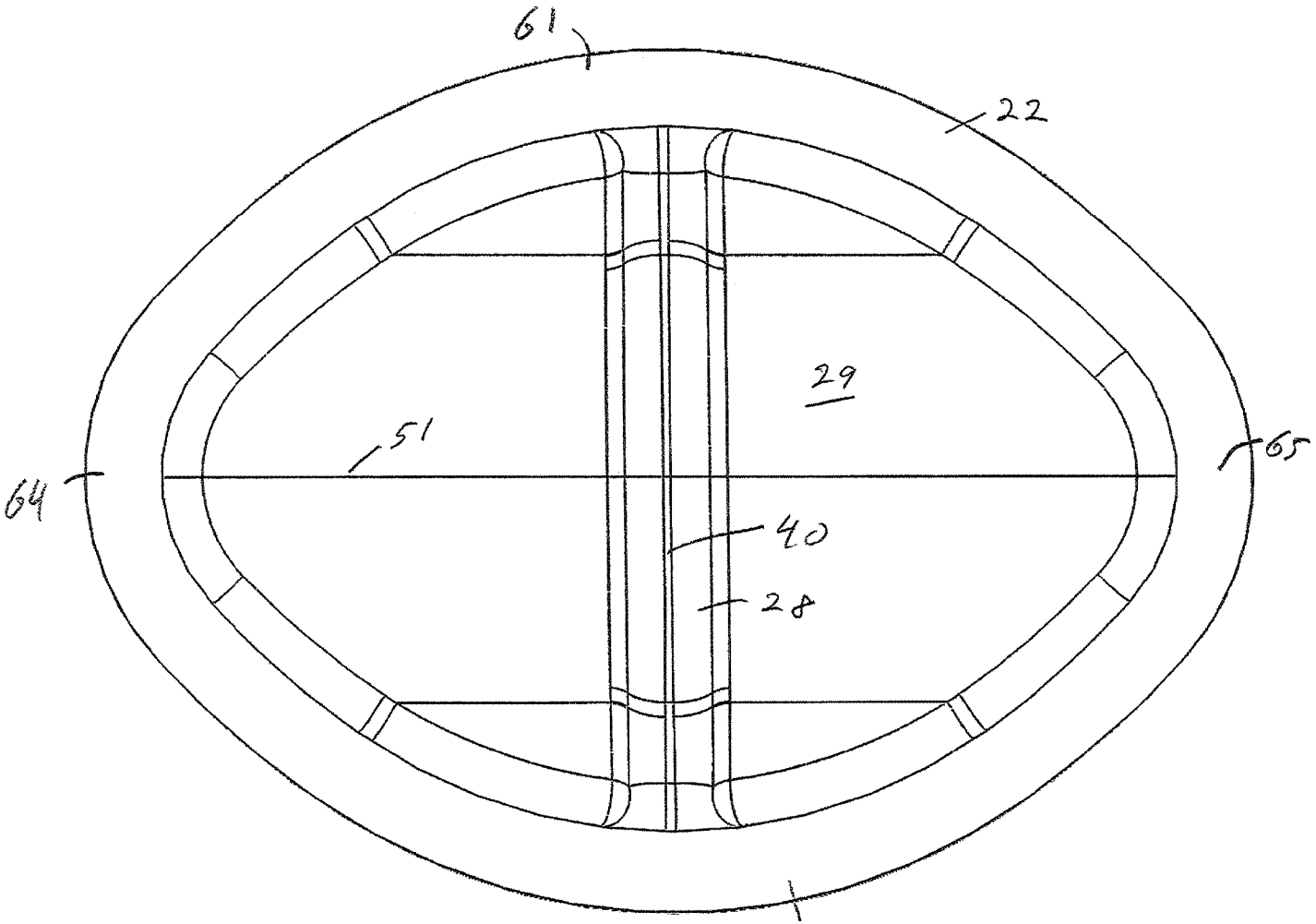
FIG. 3C a bottom view of the spout.
Figure 3D:
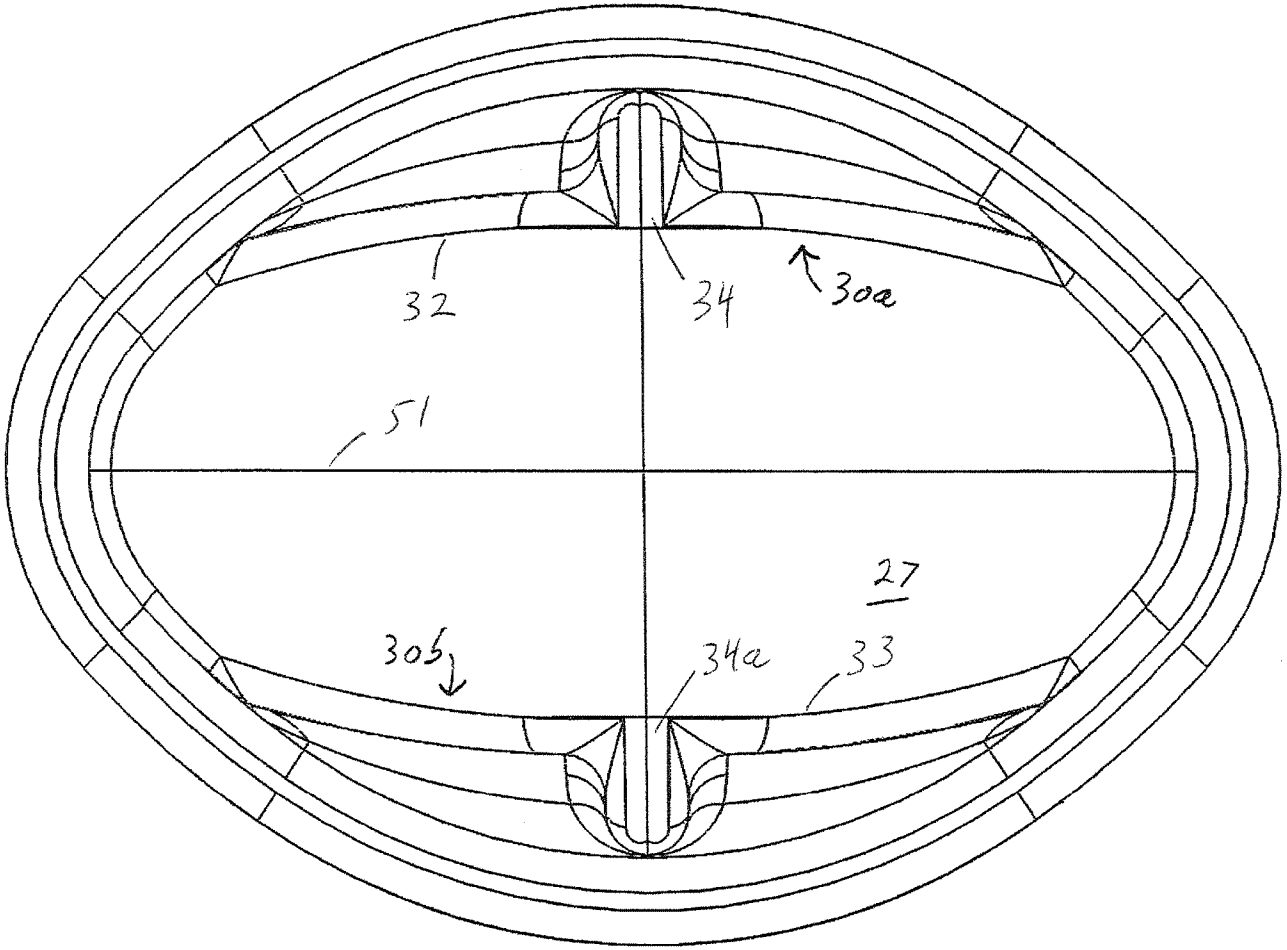
FIG. 3D is a top view of the spout.
Figure 4:
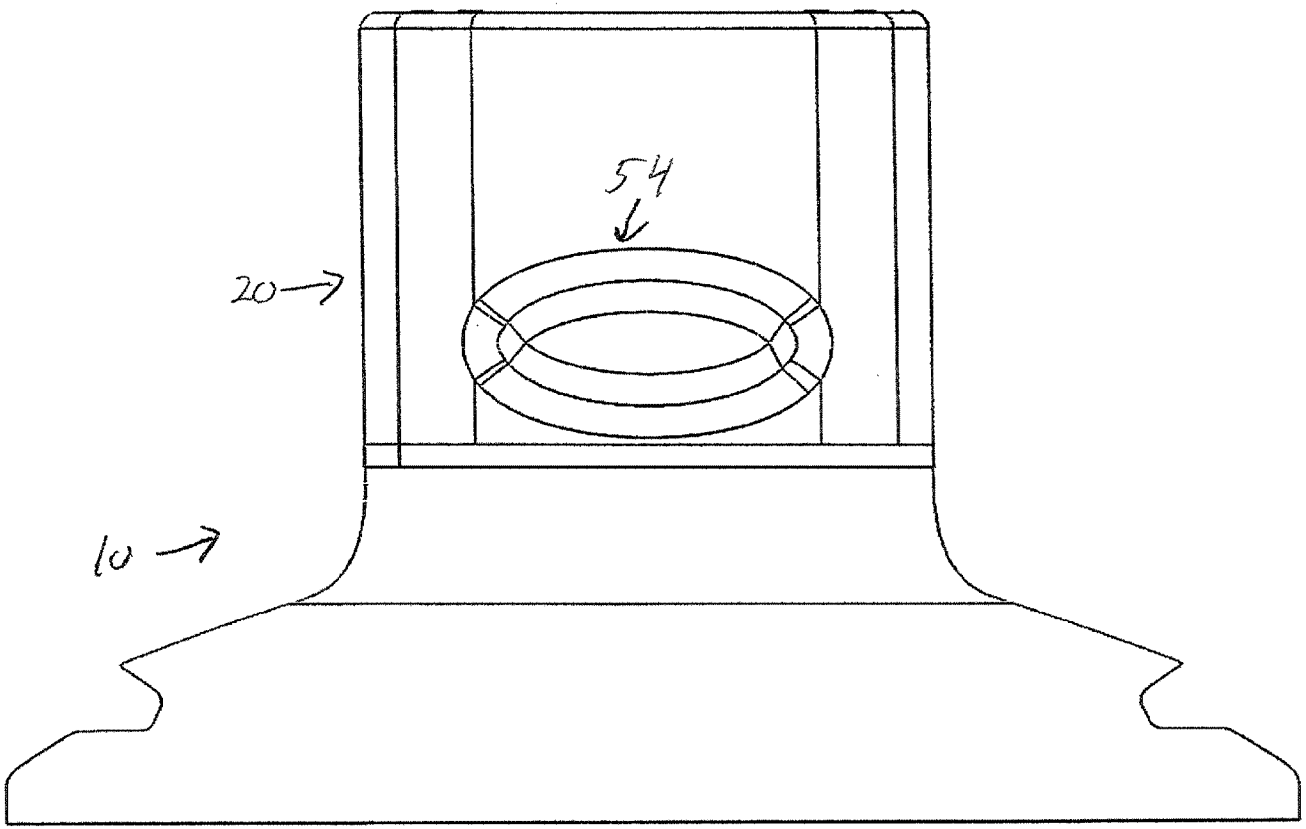
FIG. 4 is a side view of the spout and the lid.
Figure 5:
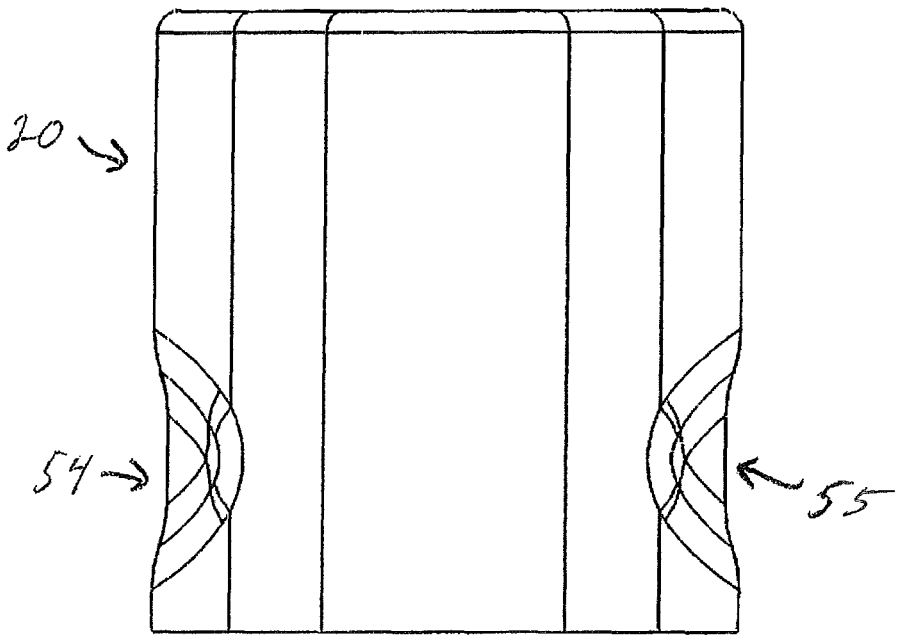
FIG. 5 is a side view of the spout.

Wall-strengthening ribs 30*a* and 30*b* are located at each end of slit 40 and are both connected to the top of membrane 26 as well as to the inside of spout sidewalls 61 and 63. Ribs 30*a* and 30*b* have inwardly-facing surfaces 32 and 33, respectively, that when viewed from the top as in FIGS. 1 and 3D are slightly concave relative to major axis 51. The faces of the ribs are shaped this way to both inhibit fatigue in the materials (stress fatigue), as well as to inhibit premature cracking of the valve when the proximal section of the valve is accidently hit or pinched slightly. Since the ribs project into the conduit from the walls, they also prevent collapse of the conduit due to suction force when the valve is being used.

Ribs 30*a* and 30*b* are preferably identical and serve to add some rigidity to sidewalls 61 and 63 so that when the sidewalls are pressed together the bending force is concentrated at locations 64 and 65. This causes the valve to open more widely than it would without these ribs. Ribs 30*a* and 30*b* thicken sidewalls 61 and 63 to allow the collapse force to focus on valve 21 and not the area proximal to valve 21. Similarly, by strengthening the area proximal to valve 21, spout 20 will not collapse when the user sucks on spout 20. Ribs 30*a* and 30*b* each have fillets 35 and 37 that connect them to membrane 26 and the sidewall that the rib projects from. Additionally, the ribs prevent occlusion of flow if the user were to completely compress (bite) the two wall sections together. Fluid will still be able to pass through the open sections of the spout. Further, rib indentations 34 and 34*a* (which may be but need not be generally semi-circular) have their lower ends located co-linearly with slit 40 to help terminate slit 40 in a manner that inhibits its propagation as spout 20 is used. The semi circle shape of the indentations is a natural stress relief shape. The curve evenly distributes stress at that location, which inhibits the propagation of the slit (effectively the slit is like shear force tear).

The semi-circular shape of ridge 28 helps to concentrate the forces applied to the underside or bottom surface 29 of membrane 26 by fluid in the cup when the cup is tilted such that fluid flows into the space just below membrane 26. The shape of ridge 28, along with the convex shape of bottom surface 29, allow the force of the fluid against the bottom of the membrane to push the two sides of membrane 26 together along slit 40, which helps to keep slit 40 closed so that the contents of the container are less likely to leak if the container is tipped over.

Figure 6A:
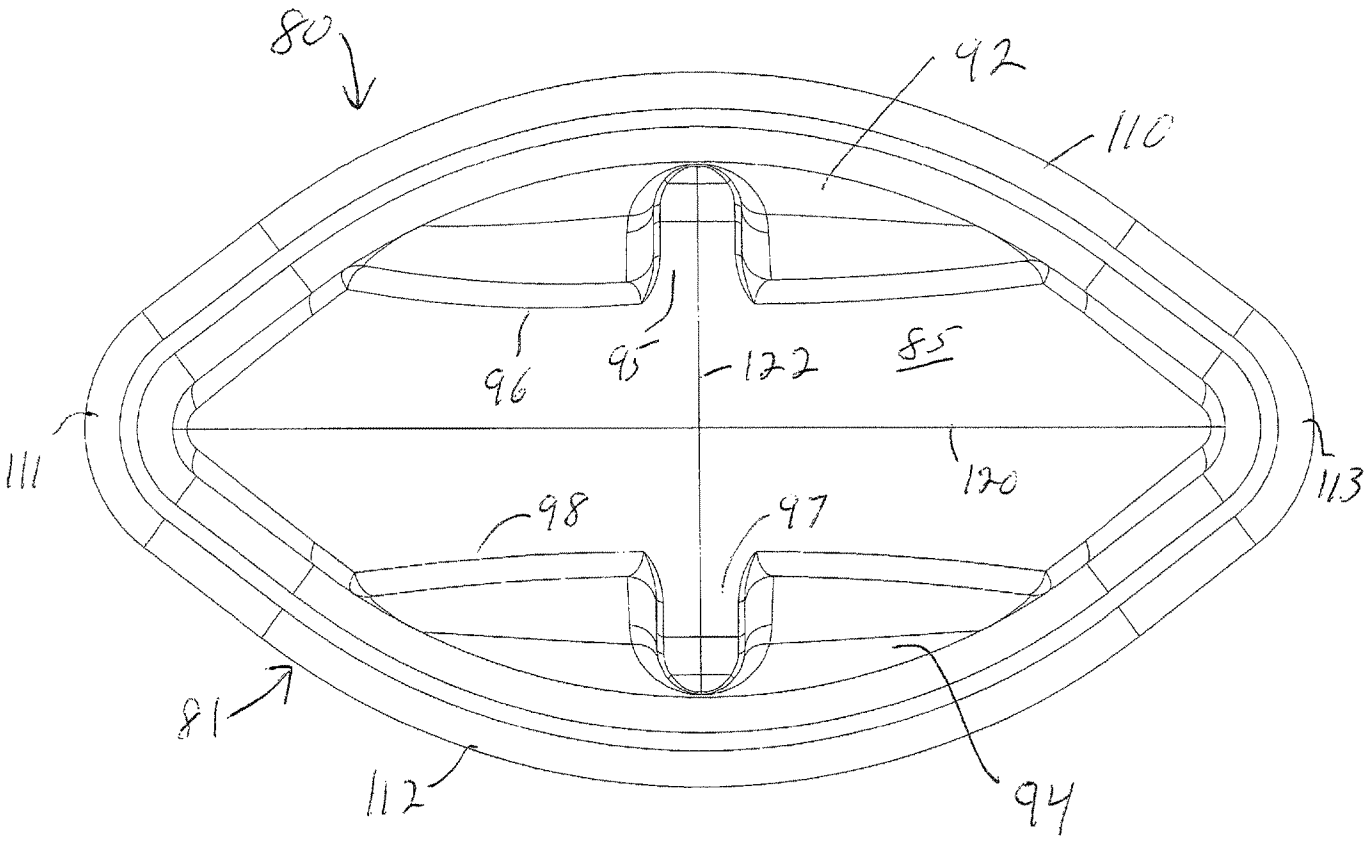
FIG. 6A is a top view of a different spout.
Figure 7:
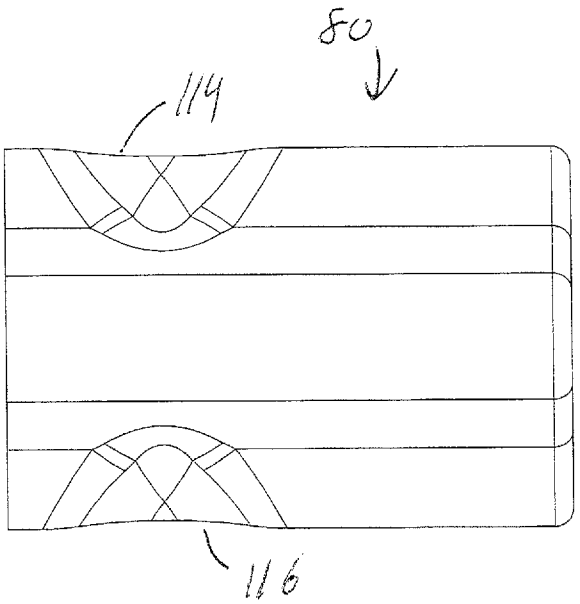
FIG. 7 is a side view of the spout of FIG. 6A.
Figure 6B:
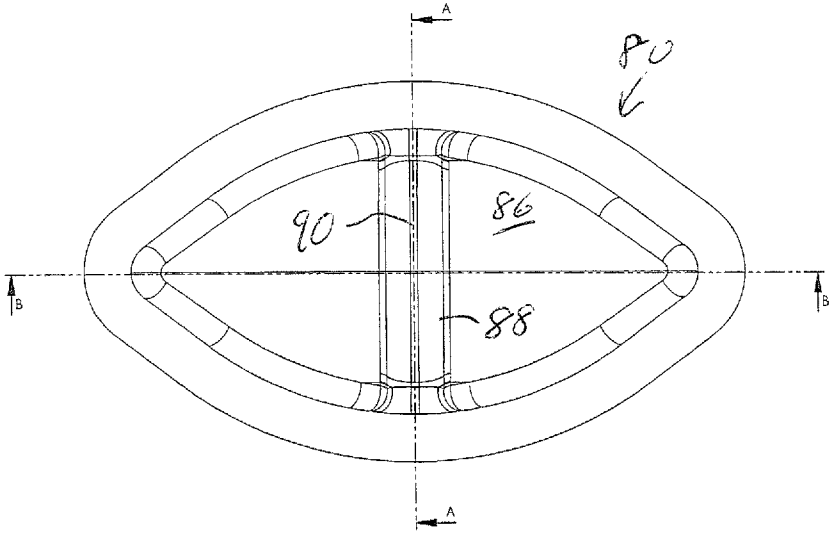
FIG. 6B is a bottom view of the spout of FIG. 6A.
Figure 6C:
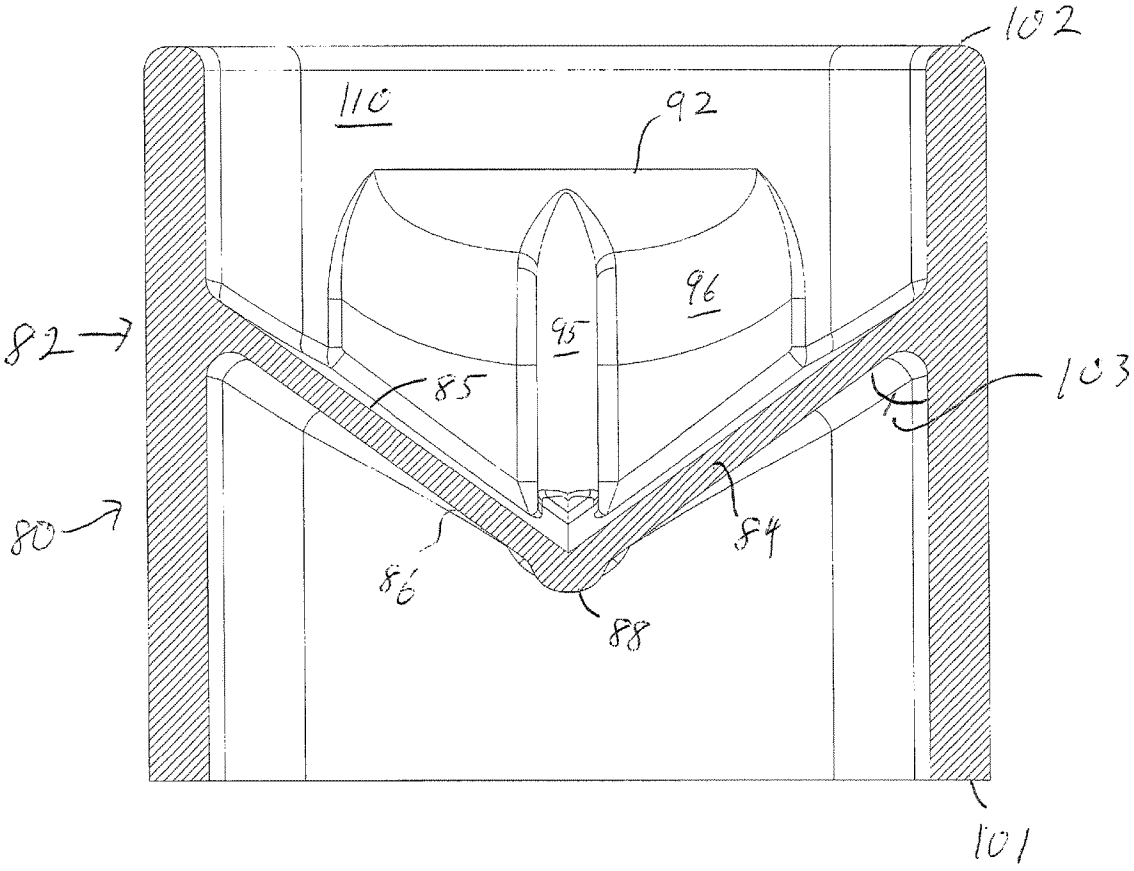
FIG. 6C is a cross-section taken along the major axis of the spout of FIG. 6A.
Figure 6D:
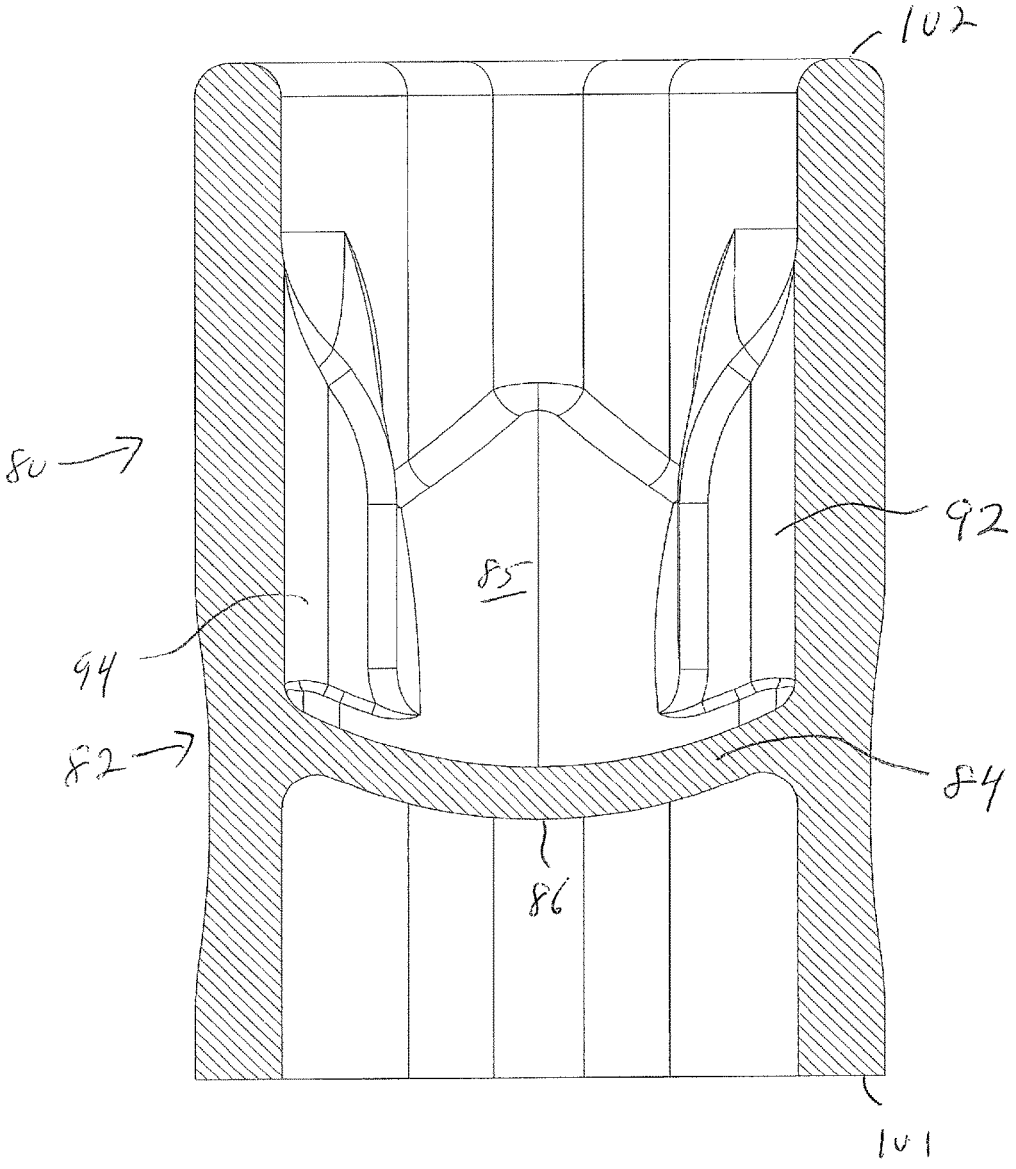
FIG. 6D is a cross-section taken along the minor axis of this spout.

Another example of a spout 80 is shown in FIGS. 6 and 7. Spout 80 is essentially the same as spout 20, except spout 80 is more pointed at its ends and is thus more almond or diamond shaped). Also, the wall strengthening ribs are shaped slightly differently. Like spout 20, spout 80 is preferably symmetric about both the major axis (120) and minor axis (122) of conduit 81. Conduit 81 has top end 102 and lower end 101, which is coupled to the lid such as lid 140, FIG. 8. Spout 80 includes spout sidewalls 110 and 112 that are convexly curved and meet at locations 111 and 113. Sidewalls 110 and 112 are slightly less convex than sidewalls 61 and 63, making the approximately oval cross-sectional shape of conduit 81 more pointed than that of conduit 22. Sidewalls 110 and 112 are thus a little less stiff than are sidewalls 61 and 63. This construction and arrangement makes valve 82 open with less force than valve 21, but the valve also opens a smaller amount and so may be more appropriate for less viscous substances than is valve 21. This construction also may make valve 82 close faster than valve 21 (presuming that the materials and the rest of the construction remains the same between the two valves), since the valve opens less. The combination of having a longer membrane sidewall (84) that is at a more acute angle creates a valve that is more sensitive to open and close, but will not open as wide, i.e., the open area for a substance to pass through will be slightly less than in spout 20.

Membrane 84 has top surface 85 and bottom surface 86, which meets the inside of conduit 81 at an angle 103 that is acute and about 45 degrees. Ridge 88 is generally semi-circular in cross-section and lies along the slit axis, which is parallel to minor axis 122, as in the first example. The lowermost extent of membrane bottom or lower surface 86 may be closer to lower end 101 of conduit 81 than is the membrane 26 of the first example. In practice the valve location could also be the top of a long straw. Also the conduit distal end 101 could extend into the cup, possibly several inches into a cup, like a straw.

Wall-strengthening ribs 92 and 94 are located at each end of slit 90 and are connected to membrane 84 as well as to the inside of spout sidewalls 110 and 112. Ribs 92 and 94 have inwardly-facing surfaces 96 and 98 that when viewed from the top as in FIG. 6A are slightly convex relative to major axis 120. They are shaped this way to both inhibit fatigue in the materials (stress fatigue) and to inhibit premature cracking of the valve when the proximal section of the valve is accidently hit or pinched slightly. The ribs also inhibit collapse due to suction force when the valve is being used. Additionally, as with spout 20, if the user completely collapses the spout proximal to the valve, fluid will still be able to be released from the valve because the ribs prevent the conduit from completely collapsing. Further, rib indentations 95 and 97 (which may be but need not be generally semi-circular) are located co-linearly with slit 90 to help terminate slit 90 in a manner that inhibits its propagation as spout 80 is used. Indentations 114 and 116 are sized, shaped and located relative to the valve in the same or a similar manner as with spout 20.

FIG. 8 depicts a non-limiting example of a cup or container 150 that carries the spout disclosed herein, in this case spout 130 located on lid 140 that has atmospheric vent 142. Also shown in this view is one of the lip locating features, 132.

Figure 9:
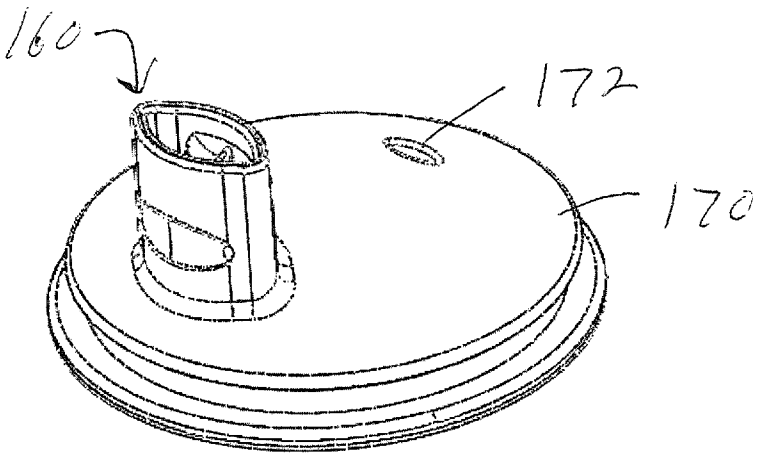
FIG. 9 shows a spout mounted to a different type of lid.

FIG. 9 illustrates that spout 160 herein can be located off-center of lid 170, which has atmospheric vent 172. This drawing also illustrates a different style of lid 170 that is flatter than lid 10. A flatter lid provides more depth between the end of the spout and the lid and thus more room for the nose and so may be easier and more comfortable to use. Also, a flatter lid is less likely to collapse inwardly toward the bottom of the cup when a differential pressure exists between the bottom and top of the lid (e.g., when suction is applied by the child) as compared to the outwardly convex lid 10.

Figure 10A:
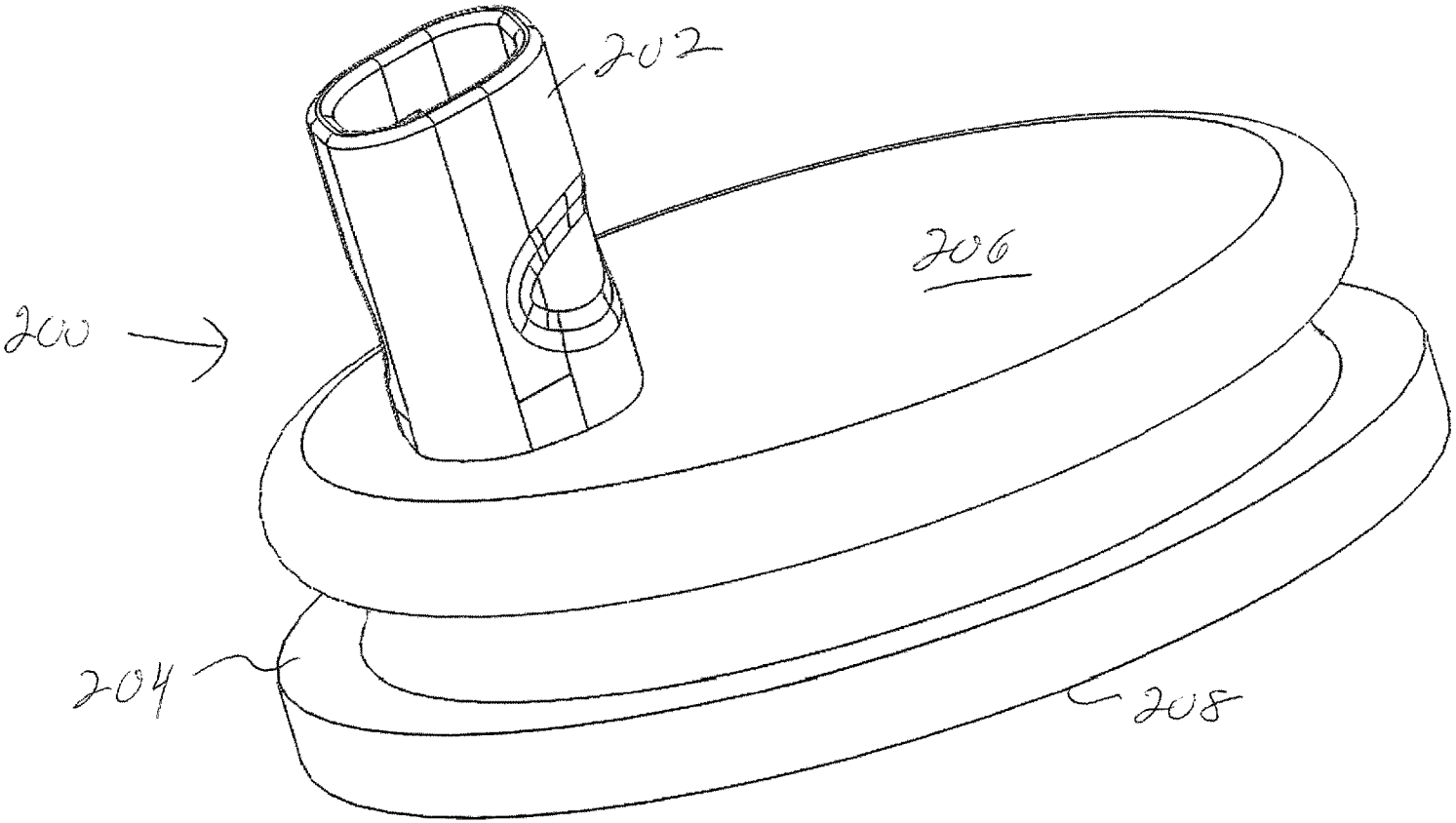
FIG. 10A is a top perspective view of a lid with a spout, where the lid is concave and the spout is located off-center.
Figure 10B:
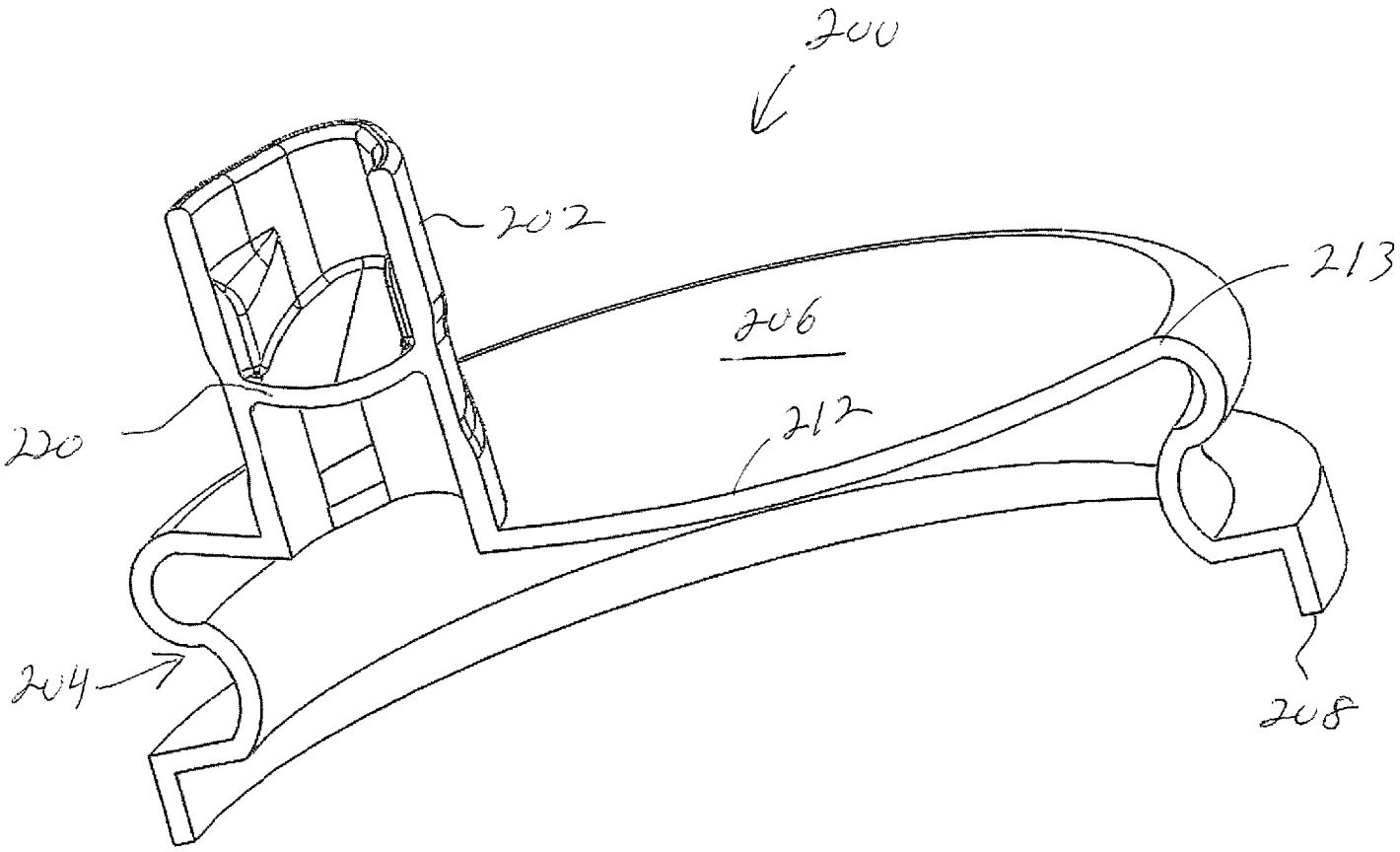
FIG. 10B is a top perspective cross-sectional view of the lid with spout of FIG. 10A, taken along the minor axis of the spout.
Figure 10C:
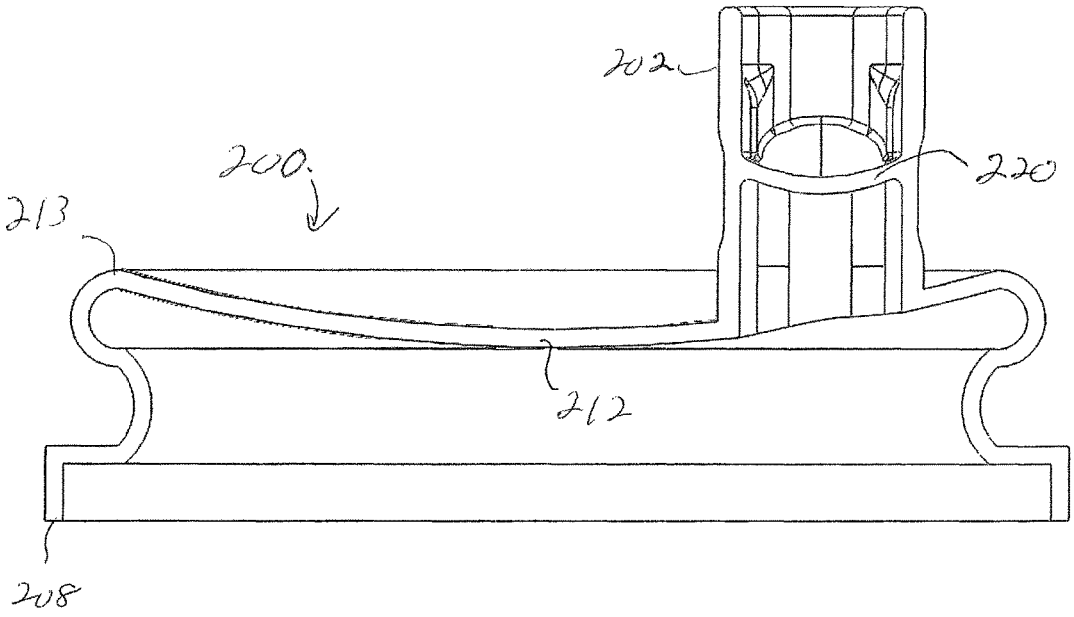
FIG. 10C is a side cross-sectional view of the lid with spout of FIG. 10A, taken along the minor axis of the spout.

FIGS. 10A-10C illustrate another example of lid 200 with lid body 204 and spout 202, which in this example is located off-center of top 206 of lid body 204. Spout 202 has the same general construction as the previous examples, with concave membrane 220 that has a slit along its minor axis, to act as a bite valve. Lid body 204 has lower rim 208 that is coupled to a container (not shown), as with the other examples herein. Top 206 of lid body 204 in this example is concave, such that its central portion 212 is lower (i.e., closer to rim 208) than is its outer portion 213. The concavity provides even more room for the child's nose, and resists collapsing under differential pressure even more than the flat top lid described above.

A number of implementations have been described. Nevertheless, it will be understood that additional modifications may be made without departing from the scope of the inventive concepts described herein, and, accordingly, other embodiments are within the scope of the following claims.

What is claimed is:

1. A spout for a lid, where the lid is constructed and arranged to fit over and close an open top of a container, the spout comprising:

an elongated fluid conduit having an upper outside end to be located in a user's mouth and an opposite lower inside end and lying along a conduit longitudinal axis, the conduit having a pair of opposed convex curved sidewalls that meet at two opposed locations at an angle of less than 180 degrees to define a generally elliptical cross-sectional shape that has a major axis that passes through the sidewall meeting locations and a minor axis that is orthogonal to the major axis;

a bite valve comprising a membrane located within the conduit and spaced from the ends of the conduit, the membrane coupled to both sidewalls so as to fully block the conduit, and a slit through the membrane, where the slit lies along a slit axis that is transverse to the major axis of the generally elliptical cross-sectional shape, and the slit is co-linear with the minor axis, or lies in a vertical plane that includes the minor axis of the generally elliptical cross-sectional shape; and two wall-strengthening ribs located at each end of the slit along the slit axis, one projecting inwardly from each of the sidewalls and coupled to the top of the membrane, wherein the ribs are centered on the ends of the slit, and each rib extends in the direction of the conduit longitudinal axis a majority of the length from the top of the membrane to the outside end of the conduit.

2. The spout of claim 1 wherein the membrane has a top surface and a bottom surface, and wherein the bite valve further comprises a reinforcing ridge projecting outwardly from the bottom of the membrane.

3. The spout of claim 2 wherein the slit is generally straight when viewed from above, and the reinforcing ridge is co-linear with the slit.

4. The spout of claim 3 wherein the slit passes through the reinforcing ridge.

5. The spout of claim 4 wherein the ridge is generally semi-circular in cross section.

6. The spout of claim 1 further comprising a pair of shallow indentations, one on the outside of each conduit sidewall, wherein each indentation is approximately aligned with a location of the slit on the inside of each conduit sidewall relative to the conduit longitudinal axis.

7. The spout of claim 1 wherein each rib defines an indentation at the slit location.

8. The spout of claim 7 wherein each indentation extends along at least most of the rib in the direction of the conduit longitudinal axis.

9. The spout of claim 1 wherein the sidewalls are essentially identical.

10. The spout of claim 1 wherein the conduit and the bite valve comprise a unitary part molded from an elastomeric material.

11. The spout of claim 1 wherein the slit extends along most of the length of the minor axis between the conduit sidewalls.

12. The spout of claim 1 wherein the bite valve is symmetric about both the major axis and the minor axis.

13. The spout of claim 1 wherein the membrane is generally uniform in thickness and along the minor axis the membrane defines an arc-shape.

14. The spout of claim 1 wherein the membrane is generally uniform in thickness and along the major axis the membrane is generally V-shaped.

15. The spout of claim 1 wherein the lid is convex, flat, or concave.

16. A spout for a lid, where the lid is constructed and arranged to fit over and close an open top of a container, the spout comprising:

an elongated fluid conduit having an upper outside end to be located in a user's mouth and an opposite lower inside end and lying along a conduit longitudinal axis, the conduit having a pair of opposed convex curved sidewalls that meet at two opposed locations at an angle of less than 180 degrees to define a generally elliptical cross-sectional shape that has a major axis that passes through the sidewall meeting locations;

a bite valve comprising a generally dome-shaped membrane located within the conduit and spaced from the ends of the conduit, the membrane coupled to both sidewalls so as to fully block the conduit, and a slit through the membrane, where the slit lies along a minor axis of the generally elliptical cross-sectional shape that is orthogonal to the major axis of the generally elliptical cross-sectional shape, wherein the membrane has a top surface and a bottom surface, and wherein the bite valve further comprises a reinforcing ridge projecting outwardly from the bottom of the membrane, wherein the slit is generally straight and lies in a vertical plane that includes the minor axis of the generally elliptical cross-sectional shape, and the reinforcing ridge is co-linear with the slit, and wherein the slit passes through the reinforcing ridge;

two wall-strengthening ribs located at each end of the slit along the minor axis of the generally elliptical cross-sectional shape, one projecting inwardly from each of the sidewalls and coupled to the top of the membrane, wherein the ribs are centered on the slit, and each rib defines an indentation at the slit location;

wherein the slit extends along most of the length of the minor axis of the generally elliptical cross-sectional shape between the conduit sidewalls and wherein the bite valve is symmetric about both the major axis and the minor axis of the generally elliptical cross-sectional shape.

17. The spout of claim 16 wherein the membrane is generally uniform in thickness, and wherein along the minor axis the membrane defines an arc-shape and along the major axis the membrane is generally V-shaped.

18. The spout of claim 16 wherein each wall-strengthening rib extends in the direction of the conduit longitudinal axis a majority of the length from the top of the membrane to the outside end of the conduit.

* * * * *